US007221254B2

(12) United States Patent
Tsukada

(10) Patent No.: US 7,221,254 B2
(45) Date of Patent: May 22, 2007

(54) CHIP RESISTOR HAVING LOW RESISTANCE AND METHOD OF MAKING THE SAME

(75) Inventor: Torayuki Tsukada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 128 days.

(21) Appl. No.: 10/518,224

(22) PCT Filed: Jun. 12, 2003

(86) PCT No.: PCT/JP03/07457

§ 371 (c)(1),
(2), (4) Date: Dec. 16, 2004

(87) PCT Pub. No.: WO04/001774

PCT Pub. Date: Dec. 31, 2003

(65) Prior Publication Data

US 2005/0225424 A1 Oct. 13, 2005

(30) Foreign Application Priority Data

Jun. 19, 2002 (JP) ..... 2002-177970
Jun. 19, 2002 (JP) ..... 2002-177971

(51) Int. Cl.
*H01C 1/012* (2006.01)

(52) U.S. Cl. ..... 338/309; 338/314; 29/610.1

(58) Field of Classification Search ..... 338/22 R, 338/22 SD, 306–309, 312–315, 322–328, 338/330; 257/508, 750, 768; 29/610.1, 29/620

See application file for complete search history.

(56) References Cited

U.S. PATENT DOCUMENTS 5,073,815 A * 12/1991 Kosaka et al. ..... 257/508
5,680,092 A * 10/1997 Yamada et al. ..... 338/309

FOREIGN PATENT DOCUMENTS

| | | |
|---|---|---|
| JP | 2000-216012 | 8/2000 |
| JP | 2001-118701 | 4/2001 |
| JP | 2001-176701 | 6/2001 |
| JP | 2002-050501 | 2/2002 |

OTHER PUBLICATIONS

English Translation for JP2002-050501 (7 pages).*

* cited by examiner

*Primary Examiner*—Tu Hoang
(74) *Attorney, Agent, or Firm*—Hamre, Schumann, Mueller & Larson, P.C.

(57) ABSTRACT

A resistor, including a resistive element made of a metal plate, has a low resistance resulting from connection terminal electrodes formed on both ends of the lower surface of the resistive element. The object thereof is to achieve weight reduction and lower costs by reducing the height of the resistor. To achieve the above object, the ends of the lower surface of the resistive element are provided with recesses for accommodating the connection terminal electrodes, while at least the intermediate area of the lower surface of the resistive element between the connection terminal electrodes is covered with an insulator. Alternatively, a recess may be formed in the middle of the lower surface of the resistive element for using the ends of the lower surface as a pair of connection terminal electrodes, the recess being internally covered with an insulator.

10 Claims, 12 Drawing Sheets

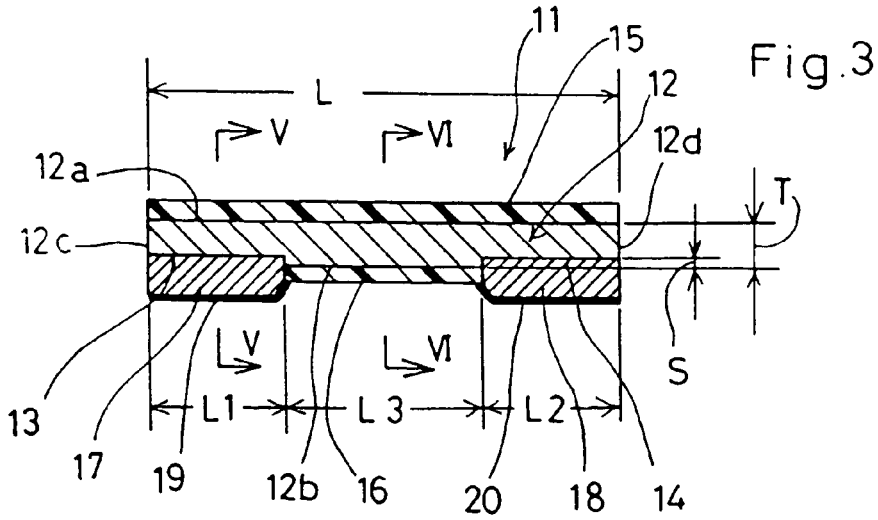
Fig.3
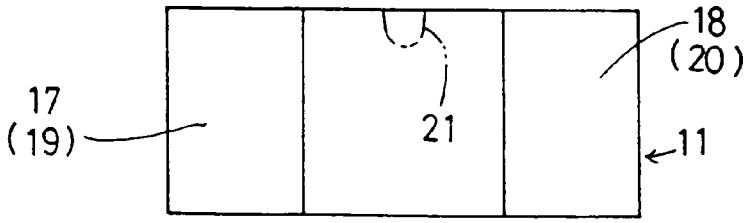
Fig.4
Fig.5
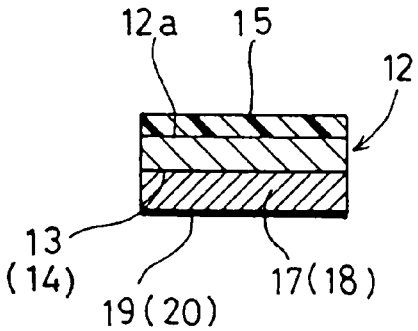
Fig.6
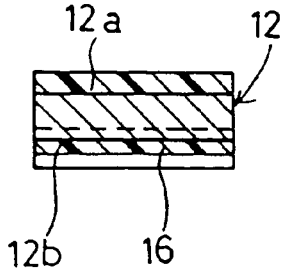

A
12
B1
B2

15
B1
B2
A
A1
A2
16

CHIP RESISTOR HAVING LOW RESISTANCE AND METHOD OF MAKING THE SAME

BACKGROUND OF THE INVENTION

The present invention relates to a chip resistor having a low resistance of, for example, no more than 1 Ω, and to a method of making the same.

As a prior art document, JP-A-2001-118701 proposes a chip resistor 1 constructed as shown in FIG. 1.

Specifically, the resistor element 2 of a chip resistor 1 of the prior art is formed in rectangular shape of metal plate of thickness T0, length L and width W, and made of a material such as an alloy constituted by adding metal having higher resistance such as nickel to a substrate metal having a low resistance such as copper. Connection terminal electrodes 4, 5 are provided in portions at the left and right ends of the lower surface of this resistor element 2, by using cutting processing to cut a recess 3 of length L0 and depth S in about the middle of the lower surface of this resistor element 2. In addition, plating layers 6, 7 are formed on these two connection terminal electrodes 4 and 5 in order to facilitate soldering to a printed circuit board, for example.

Also, in JP-A-2001-118701, when manufacturing a chip resistor constructed as described above, a method of manufacturing is proposed wherein plating layers 6, 7 for soldering are formed in a portion of each of the connection terminal electrodes 4 and 5 by plating processing in a condition with a resist mask for partial plating applied to the lower surface of the metal plate blank, the blank being formed by a large number of resistors arranged side by side in integrated fashion, and after cutting the recess 3 in the lower surface of the metal plate blank by cutting processing, the metal plate blank is then cut into each of the resistor elements.

However, with the chip resistor 1 of the prior art, there is a considerable risk that, when soldering onto the printed circuit board or the like, molten solder will become attached to portions between the two connection terminal electrodes 4, 5 on the resistor element 2 beyond the two connection terminal electrodes 4, 5, thereby producing a change in the resistance. In order to avoid this, the depth S in the recess 3 of the lower surface of the resistor element 2 may be made greater, but, if an attempt is made to increase the depth S in the recess 3 without changing the thickness T of the resistor element between the connection terminal electrodes, the overall height of the chip resistor 1 is increased and the weight is increased.

Also, in the method of manufacture of the prior art, it is arranged to form plating layers 6, 7 for soldering solely on the portions of the connection terminal electrodes 4, 5 by performing plating treatment in a condition with a resist mask for partial plating applied to the lower surface of the metal plate blank. In this manner, the manufacturing costs can be greatly increased due to the need for a step of forming a resist mask for partial plating beforehand on the lower surface of the metal plate blank prior to the plating step of forming the plating layers 6, 7 for the soldering, and also a step of separating and removing the resist mask for the partial plating after the plating step.

DISCLOSURE OF THE INVENTION

The object of the present invention is to eliminate these problems.

In order to attain this object, according to a first aspect of the present invention, there is provided a chip resistor having a low resistance. In claim 1, a recess is provided in a portion at each of the left and right ends in the lower surface of a resistor element composed of a metal plate. The recesses each are provided with connection terminal electrodes made of metal of lower resistance than the resistor element. At least a portion between the two connection terminal electrodes in the lower surface of the resistor element is covered with an insulator.

In claim 2, the surfaces of the respective connection terminal electrodes are made substantially flush with a surface of the insulator or projects from the surface of the insulator.

In claim 3, the connection terminal electrodes comprise a metal plating layer.

Regarding a method of making the chip resistor having a low resistance according to the first aspect of the present invention, in claim 5, it comprises a step of preparing a metal plate blank formed by a large number of resistor elements, each constituting a single chip resistor, arranged side by side in integrated fashion, a step of covering at least the lower surface of the metal plate blank with an insulator, a step of cutting concave grooves in portions of the left and right ends in the resistor elements in the lower surface in the metal plate blank while removing portions in the insulator corresponding to the portions of the left and right ends in the resistor elements, a step of forming a metal plating layer constituting connection terminal electrodes made of metal of lower resistance than the metal plate blank, the plating layer being in the concave grooves in the lower surface in the metal plate blank, and a step of dividing the metal plate blank into individual resistor elements.

In this way, by covering with an insulator at least the portion between the two connection terminal electrodes in the lower surface of the resistor elements comprised by the metal plate, it is possible to use this insulator to prevent contact of molten solder with the portion between the two connection terminal electrodes in the resistor element when soldering onto a printed circuit board or the like. Consequently, since it is unnecessary to increase the height of the connection terminal electrodes in order to avoid contact of the molten solder, the overall height in the chip resistor can be made correspondingly lower and a reduction in weight thereby achieved.

Also, in the prior art construction shown in FIG. 1, the resistance between the two connection terminal electrodes i.e. the resistance in the chip resistor, in addition to the resistivity in the metal constituting the resistor element 2 and the width W0 in the resistor element 2 is determined by the length L0 in the portion of the recess 3 that is cut in the lower surface in the resistor element 2 and the remaining thickness T after cutting of the recess 3 of depth S. Manufacturing variability of the length L0 and depth S in the recess 3 that is cut into the lower surface in the resistor element 2 therefore appears as variability of the resistance in the chip resistor 1. However, with the features of claim 1, since a recess is provided in a portion at both the left and right ends in the lower surface of the resistor element and connection terminal electrodes made of metal of lower resistance than the resistor element are provided within this recess, the depth of the recess that is cut in the lower surface in the resistor element has no influence or only a small influence on the resistance between the two connection terminals i.e. the resistance in the chip resistor. Consequently, when cutting the recess, the accuracy of processing the depth need not be high, and high processing accuracy need only be maintained in respect of the length. The processing required in cutting the recess in the resistor element can therefore be reduced, making it possible to reduce the manufacturing cost.

Also, by arranging that, as in claim 2, when the portion between the two connection terminal electrodes is covered with an insulator the surface of the two connection terminal electrodes is made substantially flush with the surface of the insulator or projects from the surface of the insulator, the advantage is obtained that the reliability and strength of the soldering when soldering onto a printed circuit board or the like are improved since the amount by which the two connection terminal electrodes project above the printed circuit board can be made small or eliminated.

Also, as in claim 3, by forming the two connection terminal electrodes as a metal plating layer, the height in the chip resistor can be further reduced and its weight further decreased.

Also, with a manufacturing method as in claim 5, a large number of chip resistors constructed as above can be produced from a single metal plate blank and, in addition, when forming a metal plating layer to provide the connection terminal electrodes in the recess, the insulator that is formed on the lower surface of the metal plate blank provides a mask whereby this metal plating layer is formed only in the recess. In other words, the insulator may be used to ensure that the metal plating layer is formed only in the recess, without needing to perform masking of the lower surface of the metal plate blank. This therefore simplifies the plating step and makes it possible to achieve a considerable reduction in manufacturing costs.

According to a second aspect of the present invention, there is provided a chip resistor having a low resistance. In claim 4, a recess is provided in about the middle of the lower surface in a resistor element composed of a metal plate, so that the lower surface of the resistor element has two end portions used as a pair of connection terminal electrodes, the connection terminal electrodes being formed with a plating layer, and the interior of the recess is covered with an insulator.

Regarding a method of making the chip resistor having a low resistance according to the second aspect of the present invention, in claim 6, it comprises a step of preparing a metal plate blank formed by a large number of resistor elements, each constituting a single chip resistor, arranged side by side in integrated fashion, a step of cutting concave grooves constituting recesses in about the middle of the resistor elements in the lower surface of the metal plate blank, a step of covering the interior of the concave grooves in the lower surface of the metal plate blank with an insulator, a step of forming a plating layer on the lower surface of the metal plate blank and a step of dividing the metal plate blank into individual resistor elements.

In claim 7, it comprises a step of preparing a metal plate blank formed by a large number of resistor elements, each constituting a single chip resistor, arranged side by side in integrated fashion, a step of cutting concave grooves constituting recesses in about the middle of the resistor elements of the lower surface of the metal plate blank, a step of covering the upper surface of the metal plate blank and the interior of the concave grooves in the lower surface of the metal plate blank with an insulator, a step of forming a plating layer on the lower surface of the metal plate blank and a step of dividing the metal plate blank into individual resistor elements.

In this way, by covering the interior of the recess in the lower surface of the resistor element with an insulator, adhesion of molten solder to the portion of the resistor element between the two connection terminal electrodes when soldering onto the printed circuit board or the like can be prevented by this insulator. There is therefore no need to increase the height of the connection terminal electrodes in order to avoid the aforementioned adhesion, so the overall height in the chip resistor can be correspondingly reduced and a reduction in weight thereby achieved.

Furthermore, in the manufacturing method in this case, as described in claim 6 and claim 7, plating processing for forming a plating layer for soldering on each of the connection terminal electrodes may be performed after cutting the recesses in the metal plate blank and covering the interior of these recesses with an insulator. The insulator used to cover the interior of these recesses prior to the plating step therefore functions as a mask for partial plating for forming a plating layer for soldering only at the connection terminal electrodes. The step of forming a resist mask for partial plating beforehand prior to the plating step and the step of separating and removing the resist mask for partial plating after the plating step as in the prior art can therefore be dispensed with, so the manufacturing steps can be correspondingly simplified, enabling the cost of manufacturing a chip resistor having the beneficial effects described above to be greatly reduced.

In particular, as described in claim 7, by covering the upper surface of the metal plate blank with an insulator, in the plating step of forming a plating layer for soldering on the lower surface of the metal plate blank, the formation of a plating layer on the upper surface on the blank substrate can be prevented by the insulator that covers this upper surface. In other words, the insulator that covers the upper surface of the resistor element in the chip resistor can be utilized as a mask formed beforehand on this upper surface for preventing formation of a plating layer on this upper surface in the plating step. Thus, the advantages are obtained that the plating step is simplified and manufacturing costs can be further reduced.

BRIEF DESCRIPTION OF THE DRAWINGS

FIG. 3 is a cross-sectional view seen along the line III—III of FIG. 2;

FIG. 4 is a bottom view of FIG. 2;

FIG. 5 is a cross-sectional view seen along the line V—V of FIG. 2;

FIG. 6 is a cross-sectional view seen along the line VI—VI of FIG. 2;

DESCRIPTION OF THE PREFERRED EMBODIMENTS

Figure 1:
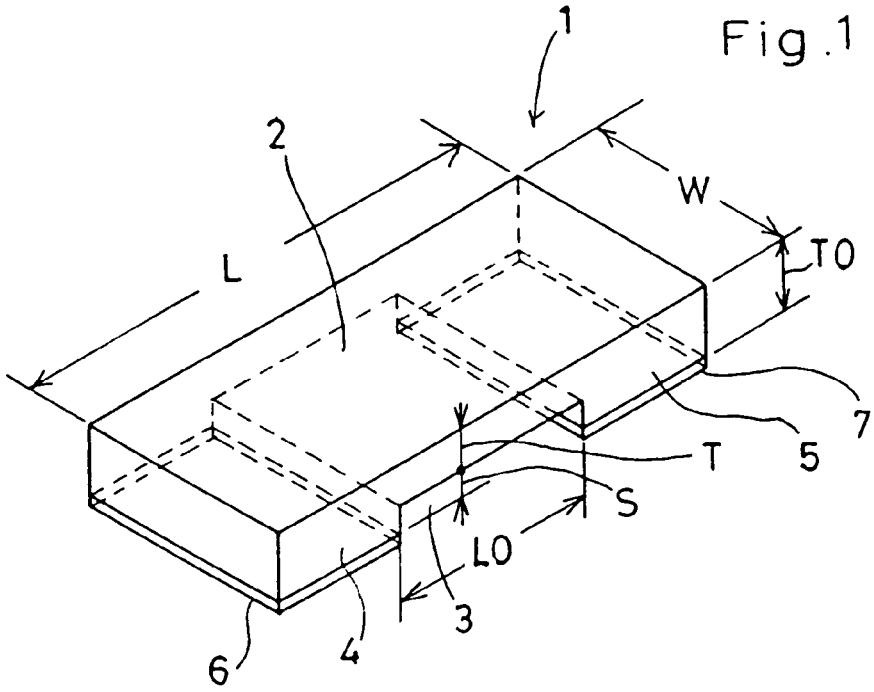
FIG. 1 is a perspective view showing a chip resistor according to the prior art.
Figure 2:
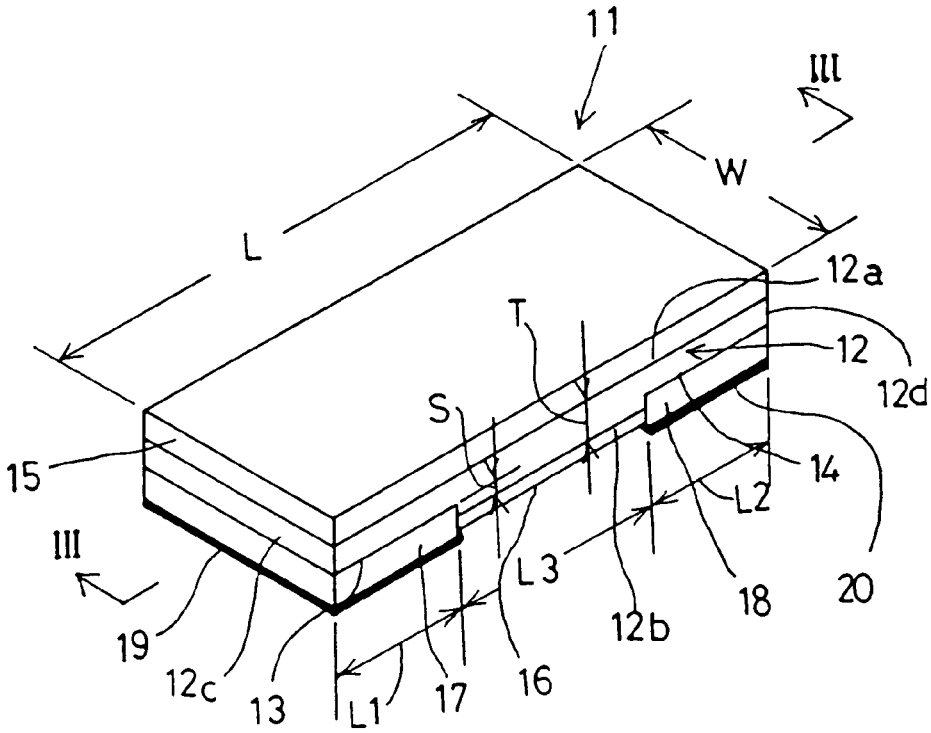
FIG. 2 is a perspective view showing a chip resistor according to a first embodiment of the present invention.

A first embodiment of the present invention is described below with reference to FIG. 2 to FIG. 6. In these Figures, the reference symbol 11 indicates a chip resistor according to an embodiment of the present invention.

This chip resistor 11 comprises a resistor element 12 formed in rectangular shape of length L and width W.

This resistor element 12 is made of metal plate of thickness T. The metal used is for example alloy such as copper-nickel alloy, nickel-chromium alloy or iron-chromium alloy in which metal (hereinafter called a high-resistant metal) having a higher resistance than a metal substrate is added to the substrate, which is made of a metal having a lower resistance (hereinafter called low-resistant metal).

In portions at the two ends of the lower surface of 12*b*, of the upper and lower surfaces 12*a* and 12*b* of the resistor element 12, recesses 13 and 14 are cut which are respectively of length L1, L2 from the two end faces 12*c*, 12*d* of this resistor element 12, and of depth S.

Also, both the upper surface 12*a* and the lower surface 12*b* of the resistor element 12 are covered with insulators 15, 16 made of for example heat-resistant synthetic resin or glass.

In addition, connection terminal electrodes 17, 18 made of pure metal such as copper are formed as a metal plating layer within the recesses 13, 14 in the portions at the two ends of the lower surface 12*b* of the resistor element 12.

The thickness of these two connection terminal electrodes 17, 18 is set to a dimension such that the surfaces thereof lie substantially in the same plane as the surface of the insulator 16 on the lower surface 12*b* of the resistor element 12, or projects slightly from the surface.

Also, plating layers 19, 20 made of tin or solder or the like are formed on the surface of the two connection terminal electrodes 17, 18 in order to facilitate soldering onto the printed circuit board or the like.

Yet further, if required, the resistance of this chip resistor 11 is adjusted to a prescribed value by cutting a trimming groove 21 shown by the double-dotted chain line in FIG. 4 in a side face of the chip resistor 11.

In the chip resistor 11 constructed in this way, molten solder can be reliably prevented from contacting the portion between the two connection terminal electrodes 17, 18 of the resistor element 12 when soldering the chip resistor 11 onto a printed circuit board or the like, by means of the insulator 16 covering the lower surface 12*b* of the resistor element 12.

Also, in the above construction, the resistance between the two connection terminal electrodes 17, 18 i.e. the resistance of this chip resistor 11 is determined by the resistivity of the metal constituting the resistor element 12, the width W of the resistor element 12 and the length L3 (L3=L−L1+L2) between the two connection terminal electrodes 17, 18 of the resistor 12. The effect that the depth S of the two recesses 13, 14 has on the resistance in the chip resistor 11 in the prior art can therefore be eliminated or decreased.

A chip resistor 11 constructed in this way can be manufactured by the following steps (1) to (7) described below.

Figure 7:
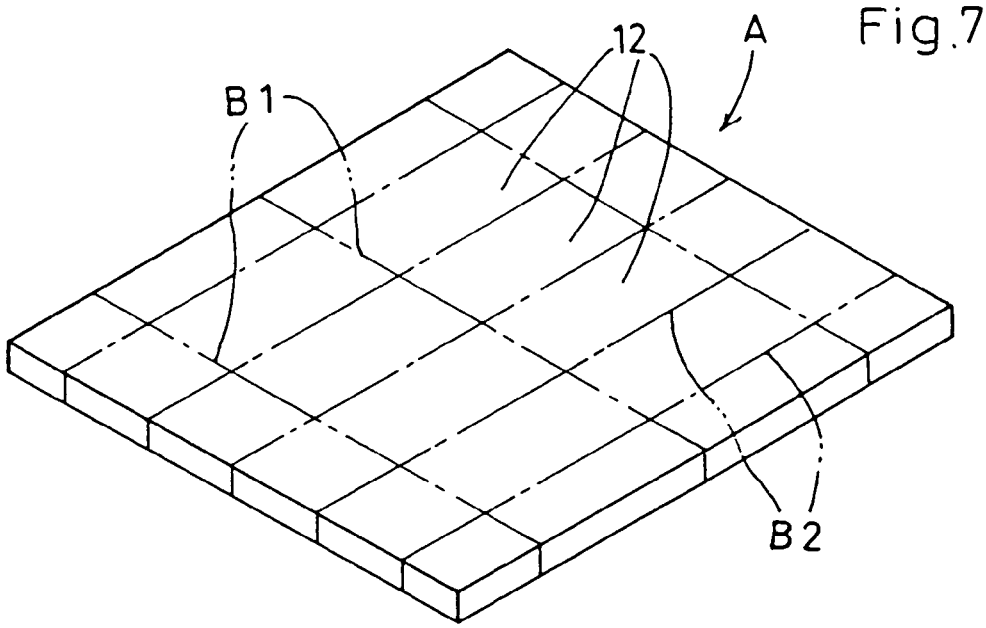
FIG. 7 is a perspective view showing a first step in a method of manufacturing a chip resistor.

(1) As shown in FIG. 7, a metal plate blank A is prepared, which is formed by a large number of resistor elements 12 constituting a single chip resistor 11 as arranged side by side in integrated fashion. Reference symbol B1 and reference symbol B2 indicate longitudinal cutting lines and transverse cutting lines that demarcate the metal plate blank A into each of the resistor elements 12.

Figure 8:
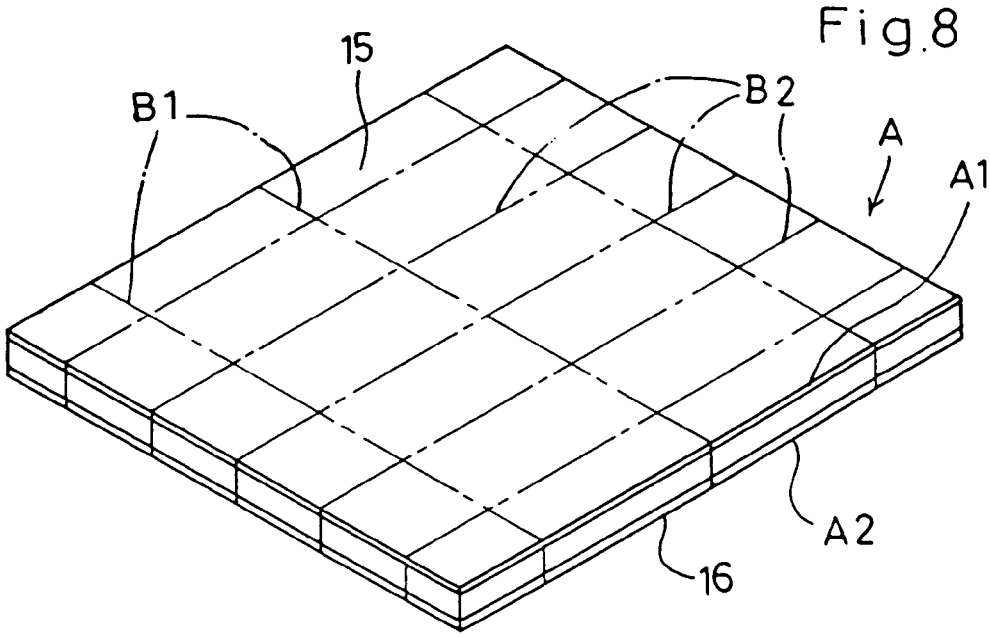
FIG. 8 is a perspective view showing a second step in the method of manufacture.

(2) Both the upper surface A1 and the lower surface A2 of the metal plate blank A are covered with insulators 15, 16 of for example heat-resistant synthetic resin or glass, as shown in FIG. 8.

Figure 9:
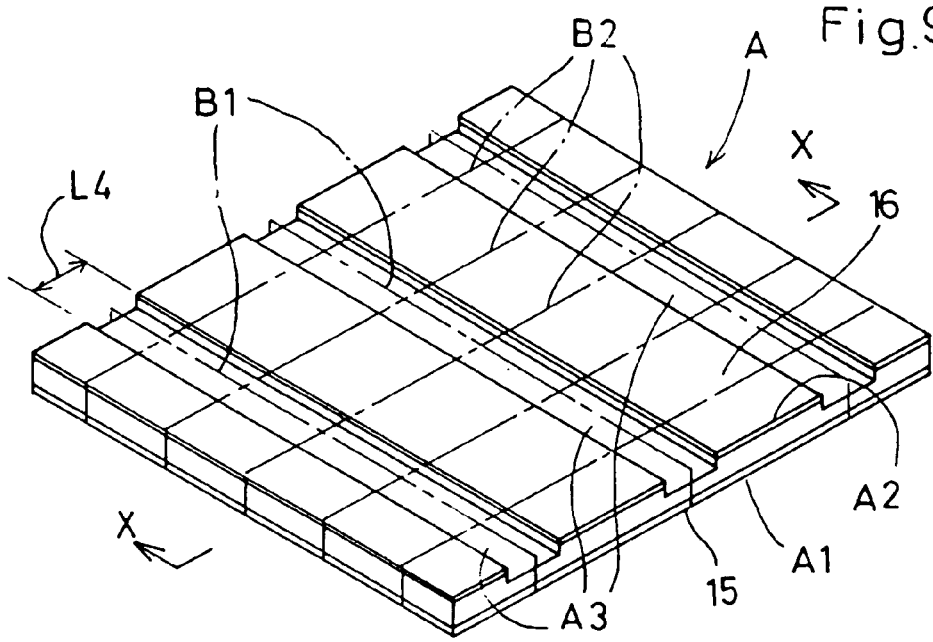
FIG. 9 is a perspective view showing a third step in the method of manufacture.
Figure 10:
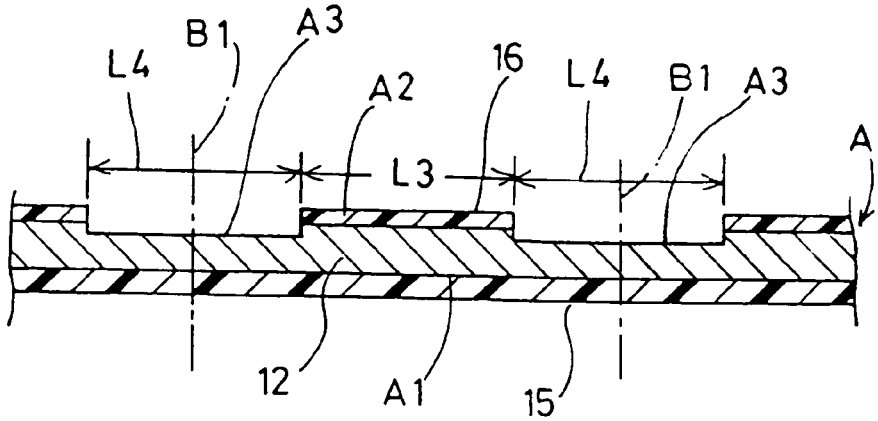
FIG. 10 is a cross-sectional view to a larger scale seen along the line X—X of FIG. 9.

(3) Concave grooves A3 for forming recesses 13, 14 in the portions at the two ends of the resistor elements 12 are then cut, as shown in FIG. 9 and FIG. 10, in the lower surface A2 of the metal plate blank A by mechanical processing such as cutting or grinding or processing using irradiation with a laser beam or coining processing or the like. In this process, the portions of the insulator 16 corresponding in position to the two recesses 13, 14 in the lower surface A2 is also removed.

The depth in the concave groove A3 which is thus cut is S (see FIG. 2) and the width L4 in this concave grooves A3 is L4=L1+L2+α (where L1 and L2 are the lengths of the two recesses 13 and 14). When using a dicing pattern or the like to cut the metal plate blank A along the cutting lines B1 in the longitudinal direction so as to divide the metal plate blank A into the individual resistor elements 12, the value of a noted above is set to the cutting width of e.g. a dicing cutter, that is, the cutting allowance. It should be noted that in the case where this division is effected by shearing processing, α is taken as =0 and the width L4 is set at L4=L1+L2. In this way, the dimension between mutually adjacent concave grooves A3 becomes the length L3 between the two recesses 13, 14 (the two connection terminal electrodes 17, 18) in the chip resistors 11, i.e. the length L3 at which the prescribed resistance is obtained.

Figure 11:
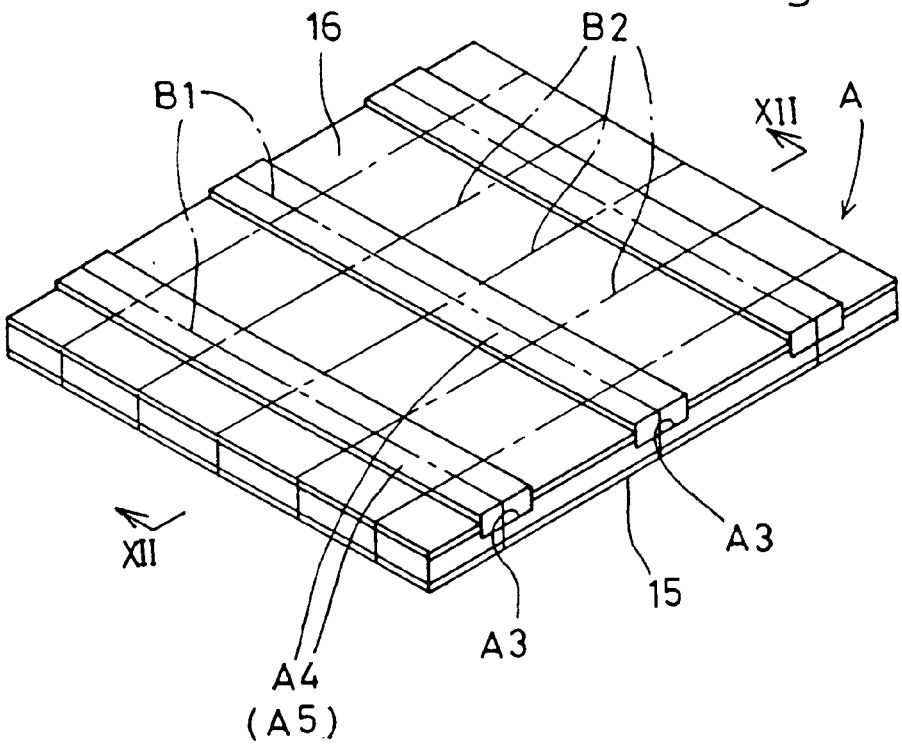
FIG. 11 is a perspective view showing a fourth step in the method of manufacture.
Figure 12:
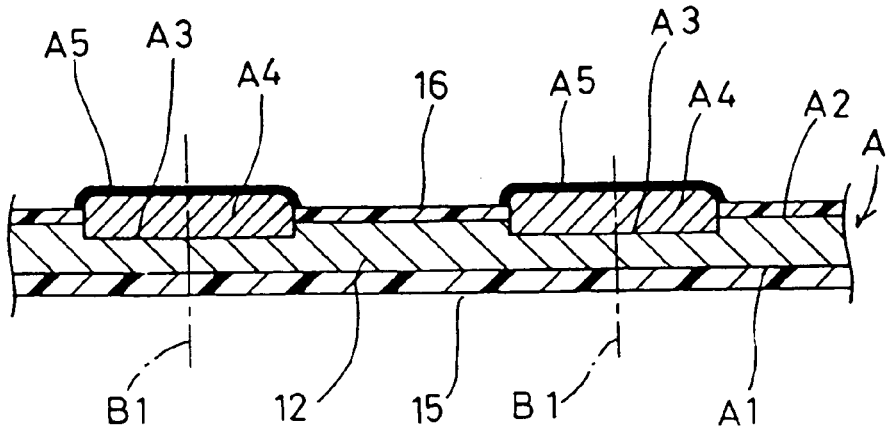
FIG. 12 is a cross-sectional view to a larger scale seen along the line XII—XII of FIG. 11.

(4) After cutting the concave grooves A3, the metal plating layer A4 is formed in the portion within the concave grooves A3 as shown in FIG. 11 and FIG. 12 by performing plating processing in respect of the entire metal plate blank A. In this way, this metal plating layer A4 provides the connection terminal electrodes 17, 18.

(5) As shown in FIG. 11 and FIG. 12, a plating layer A5 is formed on the upper surface of the metal plating layer A4 by further plating processing in respect of the entire metal plate blank A, after formation of the metal plating layer A4, and this plating layer A5 is employed for the plating layers 19, 20 for soldering.

(6) This metal plate blank A is then divided into the individual resistor elements 12 by cutting along the longitudinal cutting lines B1 and transverse cutting lines B2 using for example a dicing cutter. Also, this division could be performed using shearing processing instead of cutting using a dicing cutter or the like.

(7) If required, the resistance between the two connection terminal electrodes 17, 18 is adjusted to the prescribed value by cutting a trimming groove 21 using for example laser light irradiation onto a side face whilst measuring the resistance between the two connection terminal electrodes 17, 18.

By going through these steps, a large number of chip resistors 11 of the construction shown in FIG. 2 to FIG. 6 can be manufactured from a single metal plate blank A.

In this manufacture, the insulators 15, 16 that cover the upper and lower surfaces A1, A2 of the metal plate blank A provide masks when forming the connection terminal electrodes 17, 18 only on the portion within the concave grooves A3 by plating processing and when forming the plating layers 19, 20 for soldering purposes by plating processing only of the surface of these connection terminal electrodes 17, 18.

Figure 13:
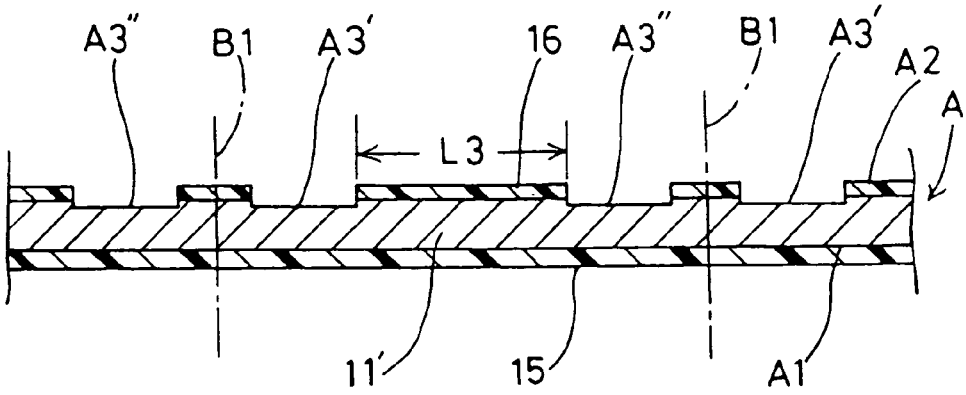
FIG. 13 is a cross-sectional view showing a first step in a further method of manufacture.
Figure 14:
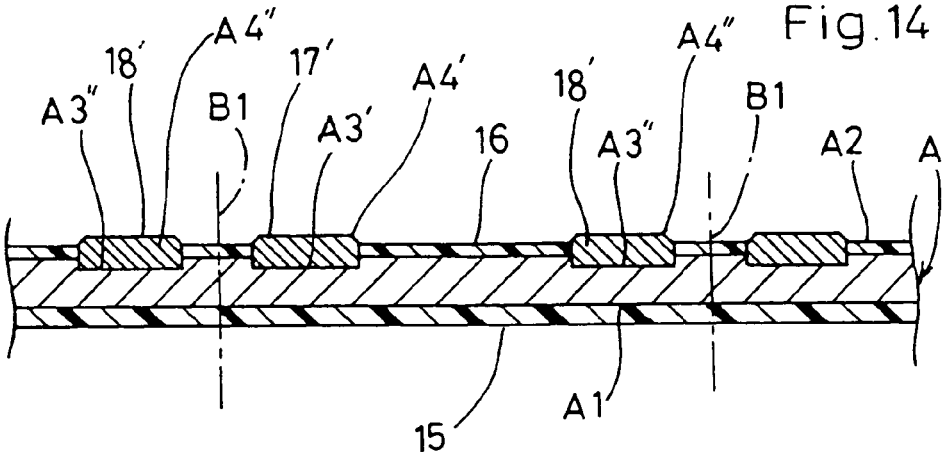
FIG. 14 is a cross-sectional view showing a second step in a further method of manufacture.

Next, FIG. 13 and FIG. 14 show a manufacturing method according to an embodiment of the present invention.

In the method, as shown in FIG. 13, the concave groove A3 mentioned above comprises a concave groove A3' for forming a single recess 13' in the resistor element 12 and a concave groove A3" for forming the other recess 14', and the dimension between these two adjacent concave grooves A3', A3" (i.e. the dimension between the adjacent concave grooves A3', A3" on the side where the cutting line B1 is not located) constitutes the length L3 whereby the prescribed resistance is obtained.

Thus, as shown in FIG. 14, within the concave grooves A3', A3", metal plating layers A4', A4" are formed by plating processing and these metal plating layers A4', A4" are employed as the connection terminal electrodes 17', 18'. Apart from this, this method is the same as in the case of the method (1) to (7) described above and makes it possible to obtain chip resistors 11' of the construction shown in FIG. 15.

Figure 15:
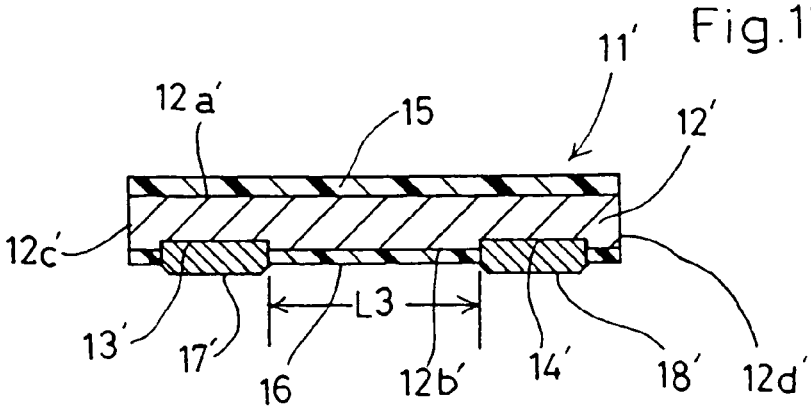
FIG. 15 is a cross-sectional view of a chip resistor according to a further method of manufacture.

In other words, "recesses are provided in a portion at the left and right ends on the lower surface of the resistor element" in the first embodiment of the present invention means that there are included both the case where, as shown in FIG. 3, the two recesses 13, 14 are in contact with the two end surfaces 12*c*, 12*d* of the resistor element 12 and the case where, as shown FIG. 15, the two recesses 13', 14' that form the respective connection terminal electrodes 17', 18' are close to but do not contact the two end surfaces 12*c'*, 12*d'* of the resistor element 12'.

Next, a second embodiment of the present invention will be described with reference to FIG. 16 to FIG. 20.

In these Figures, the reference symbol 111 indicates a chip resistor according to the second embodiment of the present invention.

This chip resistor 111 comprises a resistor element 112 that is formed in a rectangular shape with a length L and a width W.

This resistor element 112 is made of metal plate of thickness T. The metal used is for example alloy such as copper-nickel alloy, nickel-chromium alloy or iron-chromium alloy in which metal (hereinafter called a high-resistant metal) having a higher resistance than a substrate is added to the substrate, which is made of a metal having a lower resistance (hereinafter called low-resistant metal).

Connection terminal electrodes 117, 118 are formed at portions at the two ends thereof by cutting a recess 113 of length L0 and depth S in the lower surface of the upper and lower surfaces of the resistor element 112, in about the middle thereof.

In order to facilitate soldering onto a printed circuit board or the like, plating layers 119, 120 comprising for example an underlayer of copper plating onto which tin plating is applied are formed on these two connection terminal electrodes 117, 118.

Also, in addition to covering the upper surface of the resistor element 112 with an insulator 115 made of for example heat-resistant synthetic resin or glass, the interior of the recess 13 in the lower surface is covered with an insulator 116 made of for example heat-resistant synthetic resin or glass.

Figure 18:
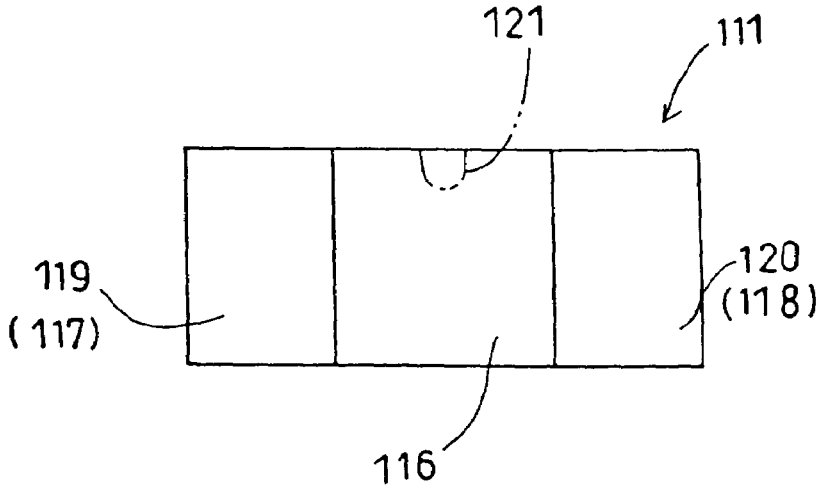
FIG. 18 is a bottom view of FIG. 16.

It should be noted that, if required, the resistance of this chip resistor 111 may be adjusted to a prescribed value by cutting a trimming groove 121 shown by the double-dotted chain line in FIG. 18 in a side face of the chip resistor 111.

In the chip resistor 111 constructed in this way, molten solder can be reliably prevented from contacting the portion between the two connection terminal electrodes 117, 118 of the resistor element 112 when soldering the chip resistor 111 onto a printed circuit board or the like, by means of the insulator 116 covering the recess 113 of the lower surface of the resistor element 112.

A chip resistor 111 constructed in this way can be manufactured by the steps (1) to (6) described below.

Figure 19:
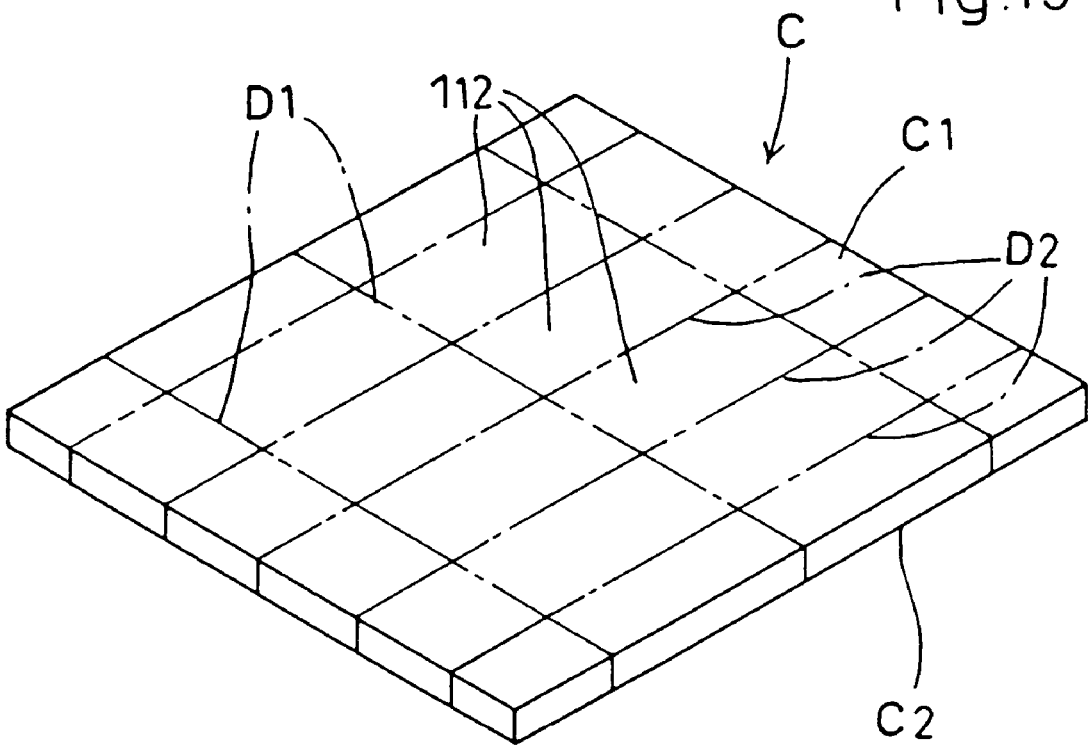
FIG. 19 is a perspective view showing a first step in a method of manufacturing a chip resistor.

(1) As shown in FIG. 19, a metal plate blank C is prepared, which is formed by a large number of resistor elements 112 constituting a single chip resistor 111 as arranged side by side in integrated fashion. Reference symbol D1 and reference symbol D2 indicate longitudinal cutting lines and transverse cutting lines that demarcate the metal plate blank C into each of the resistor elements 112.

Figure 20:
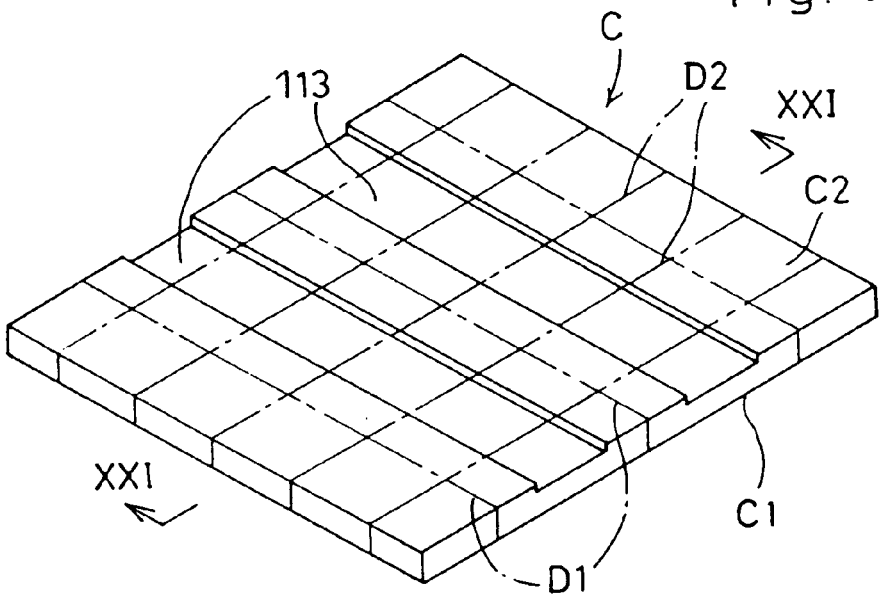
FIG. 20 is a perspective view showing a second step in the method of manufacture.
Figure 21:
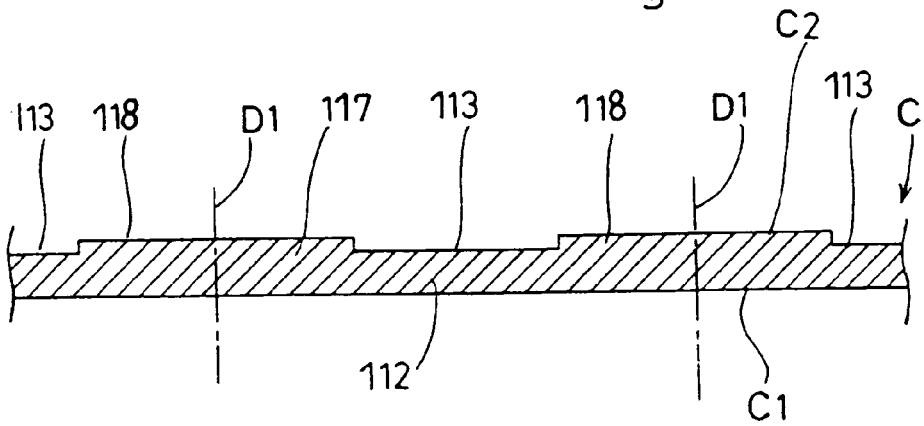
FIG. 21 is a cross-sectional view to a larger scale shown along the line XXI—XXI of FIG. 20.

(2) The lower surface C2, of the upper surface C1 and lower surface C2 of the metal plate blank C, is turned upwards and the recess 113 is made as shown in FIG. 20 and FIG. 21 by for example mechanical processing such as cutting or grinding or processing using irradiation with laser light, or coining processing, such that the recess 113 extends parallel with the longitudinal cutting line D1 in the portion in about the middle of the resistor elements 112 of the lower surface C2.

Figure 16:
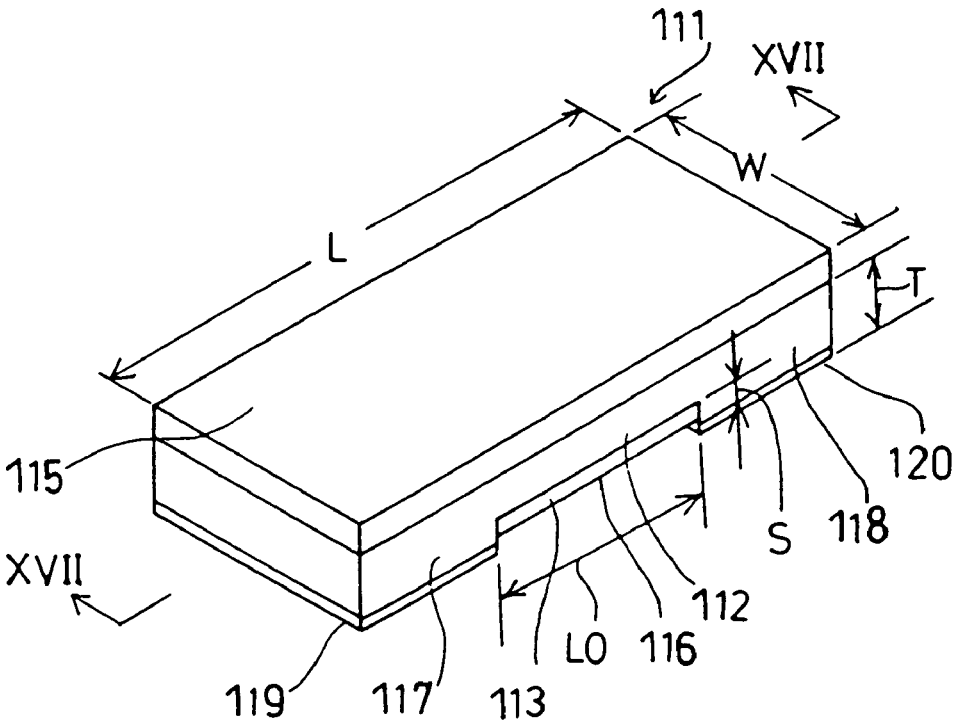
FIG. 16 is a perspective view showing a chip resistor according to a second embodiment of the present invention.

The depth of the recess 113 that is thus cut is S and the width of this recess 113 is L0 (see FIG. 16).

Figure 22:
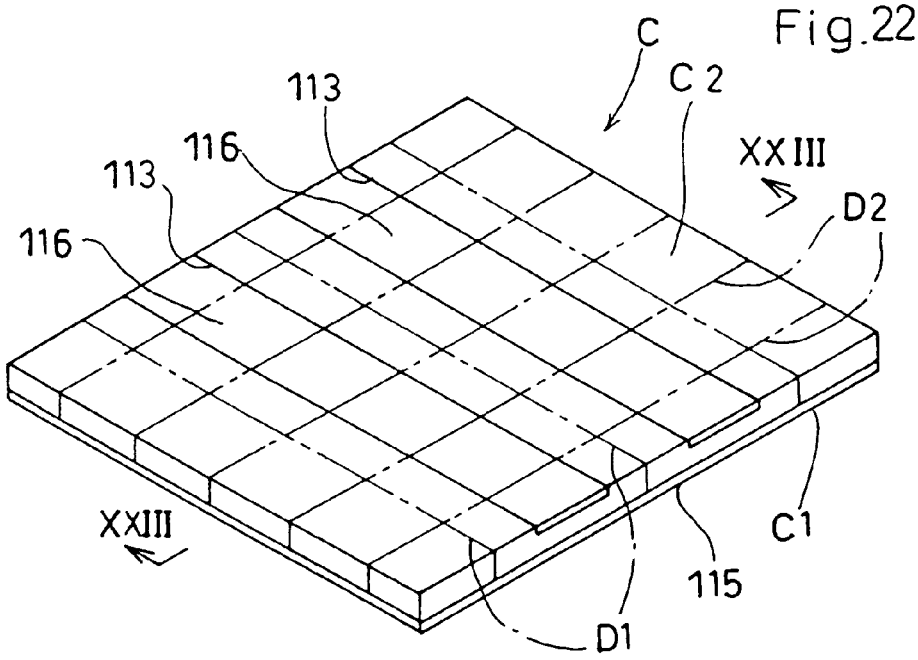
FIG. 22 is a perspective view showing a third step in the method of manufacture.
Figure 23:
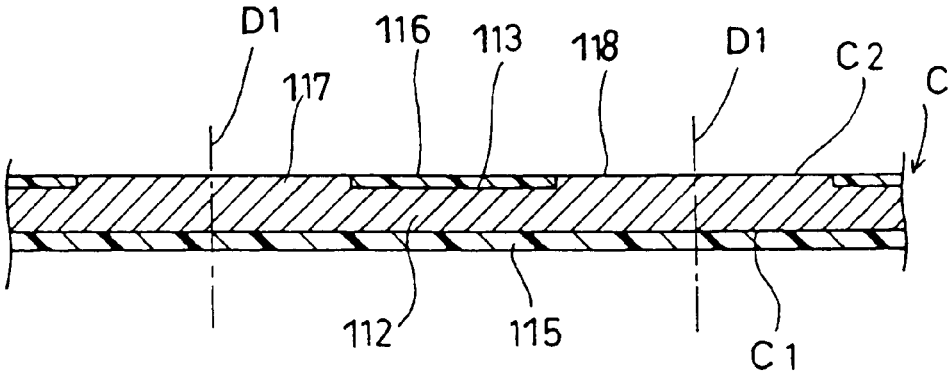
FIG. 23 is a cross-sectional view to a larger scale shown along the line XXIII—XXIII of FIG. 22.

(3) Then, in addition to covering the surface of the metal plate blank C with an insulator 18 such as heat-resistant synthetic resin or glass as shown in FIG. 22 and FIG. 23, the interior of the recesses 113 of the lower surface C2 is covered with an insulator 116 such as heat-resistant synthetic resin or glass.

Figure 24:
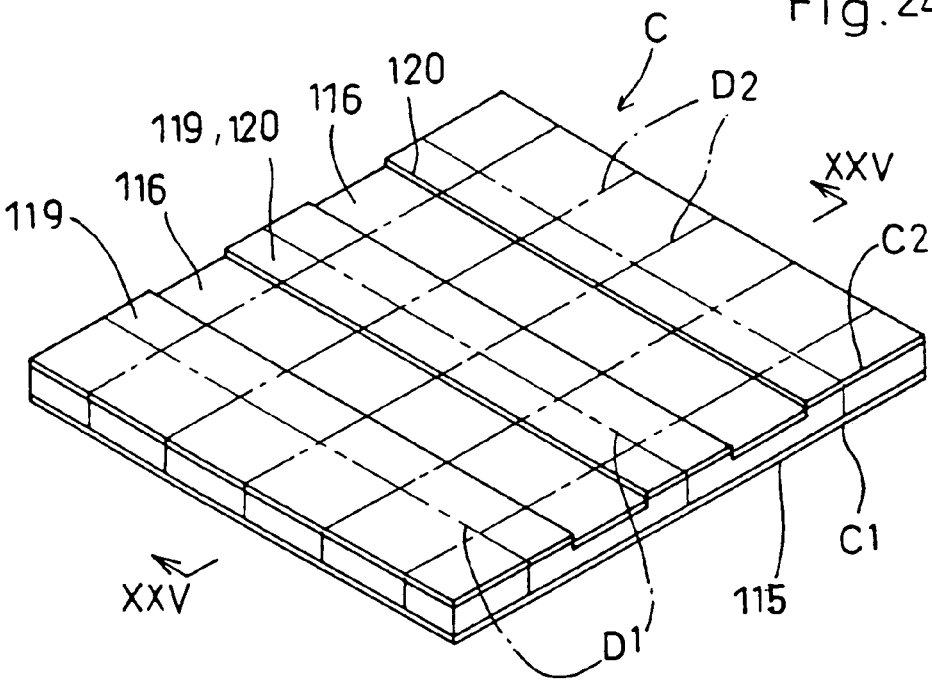
FIG. 24 is a perspective view showing a fourth step in the method of manufacture.
Figure 25:
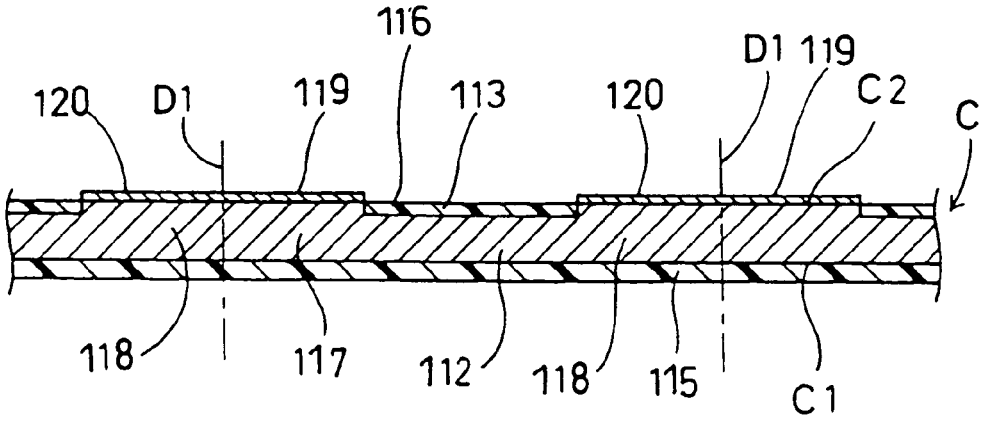
FIG. 25 is a cross-sectional view to a larger scale shown along the line XXIV—XXIV of FIG. 24.

(4) Next, as shown in FIG. 24 and FIG. 25, by performing plating processing of the metal plate blank C in a plating solution, plating layers 119, 120 are formed in the portions of the lower surface C2 of this metal plate blank C excluding those of the insulator 116 that covers the interior of the recess 113 i.e. in the portions of the connection terminal electrodes 117, 118 of the resistor elements 112.

(5) The metal plate blank C is then divided into the resistor elements 112 by cutting along the longitudinal cutting lines D1 and the transverse cutting lines D2 with the use of a dicing cutter, for example. The cutting of the metal plate blank C into the resistor elements 112 can also be performed using shearing processing.

(6) If required, the resistance between the two connection terminal electrodes 117, 118 is then adjusted to the prescribed value by cutting a trimming groove 121 using for example laser light irradiation onto a side face whilst measuring the resistance between the two connection terminal electrodes 117, 118.

Figure 17:
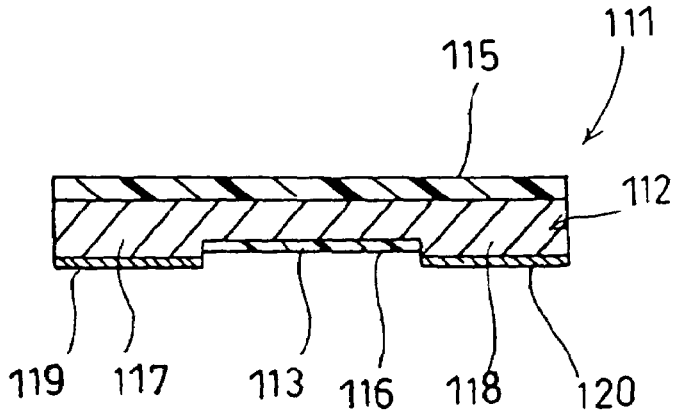
FIG. 17 is a cross-sectional view seen along the line XVII—XVII of FIG. 16.

By going through these steps, a large number of chip resistors 111 of the construction shown in FIG. 16 to FIG. 18 can be manufactured from a single metal plate blank C.

In this manufacture, the insulators 115, 116 that cover the upper and lower surfaces C1, C2 of the metal plate blank C function as masks for plating when the plating layers 119, 120 are formed by plating processing only of the portions of the connection terminal electrodes 117, 118 of the lower surface C2 of the metal plate blank C.

The invention claimed is:

1. A chip resistor comprising:

a resistor metal plate having an upper surface, a lower surface, and a pair of end surfaces;

a pair of lower end recesses each formed directly on the lower surface of the resistor metal plate adjacent to a respective one of the end surfaces of the resistor metal plate;

a pair of connection terminal electrodes each formed in a respective one of the lower end recesses;

an upper insulating layer formed on the upper surface of the resistor metal plate without covering the end surfaces;

a lower insulating layer formed on the lower surface of the resistor metal plate between the connection terminal electrodes without covering the end surfaces of the resistor metal plate.

2. The chip resistor according to claim 1, wherein each of the connection terminal electrodes is substantially flush with or projects from a lower surface of the lower insulating layer.

3. The chip resistor according to claim 1, wherein each of the connection terminal electrodes comprises a metal plating layer.

4. A chip resistor comprising:

a resistor metal plate having an upper surface, a lower surface, and a pair of end surfaces;

a lower intermediate recess formed directly on the lower surface of the resistor metal plate between the end surfaces of the resistor metal plate;

a pair of connection terminal electrodes each formed on the lower surface of the resistor metal plate adjacent to a respective one of the end surfaces of the resistor metal plate to flank the lower intermediate recess;

an upper insulating layer formed on the upper surface of the resistor metal plate without covering the end surfaces;

a lower insulating layer formed in the lower intermediate recess between the connection terminal electrodes without covering the end surfaces of the resistor metal plate.

5. The chip resistor according to claim 4, wherein each of the connection terminal electrodes is substantially flush with or projects from a lower surface of the lower insulating layer.

6. The chip resistor according to claim 1, wherein each of the connection terminal electrodes comprises a metal plating layer.

7. A method of making a chip resistors, each of the chip resistors comprising:

a resistor metal plate having an upper surface, a lower surface, and a pair of end surfaces;

a lower intermediate recess formed directly on the lower surface of the resistor metal plate between the end surfaces of the resistor metal plate;

a pair of connection terminal electrodes each formed on the lower surface of the resistor metal plate adjacent to a respective one of the end surfaces of the resistor metal plate to flank the lower intermediate recess;

an upper insulating layer formed on the upper surface of the resistor metal plate without covering the end surfaces;

a lower insulating layer formed in the lower intermediate recess between the connection terminal electrodes without covering the end surfaces of the resistor metal plate;

the method comprising the steps of:

preparing a metal plate blank corresponding to a plurality of resistor metal plates arranged side by side in a first direction and in a second direction perpendicular to the first direction;

covering the upper and lower surfaces of the metal plate blank with upper and lower insulating layers, respectively;

cutting grooves in the lower surface of the metal plate blank by removing portions of the lower insulating layer corresponding to the grooves, the grooves extending in the first direction in parallel to each other;

forming connection terminal electrodes in the respective grooves; and dividing the metal plate blank along the first and second directions into the plurality of resistor metal plates.

8. The method according to claim 7, wherein the division of the metal plate blank along the first direction is performed at the respective connection terminals.

9. The method according to claim 7, wherein the division of the metal plate blank along the first direction is performed between the connection terminals.

10. A method of making a chip resistors, each of the chip resistors comprising:

a resistor metal plate having an upper surface, a lower surface, and a pair of end surfaces;

a pair of lower end recesses each formed directly on the lower surface of the resistor metal plate adjacent to a respective one of the end surfaces of the resistor metal plate;

a pair of connection terminal electrodes each formed in a respective one of the lower end recesses;

an upper insulating layer formed on the upper surface of the resistor metal plate without covering the end surfaces;

a lower insulating layer formed on the lower surface of the resistor metal plate between the connection terminal electrodes without covering the end surfaces of the resistor metal plate;

the method comprising the steps of:

preparing a metal plate blank corresponding to a plurality of resistor metal plates arranged side by side in a first direction and in a second direction perpendicular to the first direction;

cutting grooves in the lower surface of the metal plate blank, the grooves extending in the first direction in parallel to each other;

covering an upper surface of the metal plate blank with an upper insulating layer while forming a lower insulating layer in each of the grooves;

forming connection terminal electrodes on portion of the lower surface of the metal plate blank other than the grooves; and dividing the metal plate blank along the first and second directions into the plurality of resistor metal plates, the division of the metal plate blank along the first direction being performed at the connection terminal electrodes.

* * * * *